US006815879B2

(12) United States Patent
Nakamura et al.

(10) Patent No.: US 6,815,879 B2
(45) Date of Patent: Nov. 9, 2004

(54) CIRCULAR FLUORESCENT LAMP INCLUDING AN INSULATOR BETWEEN CONDUCTIVE WIRES, AND A LIGHTING FIXTURE USING THE LAMP

(75) Inventors: Toshiyuki Nakamura, Kanagawa-ken (JP); Yoshiyuki Matsunaga, Kanagawa-ken (JP)

(73) Assignee: Toshiba Lighting & Technology Corporation, Tokyo (JP)

( * ) Notice: Subject to any disclaimer, the term of this patent is extended or adjusted under 35 U.S.C. 154(b) by 289 days.

(21) Appl. No.: 09/783,588

(22) Filed: Feb. 15, 2001

(65) Prior Publication Data

US 2003/0025432 A1 Feb. 6, 2003

(30) Foreign Application Priority Data

Feb. 16, 2000 (JP) ..... 2000-037581
Jul. 26, 2000 (JP) ..... 2000-224788

(51) Int. Cl.[7] ..... H01J 61/72

(52) U.S. Cl. ..... 313/318.02; 313/317; 313/493; 313/623; 313/634; 362/216; 362/222

(58) Field of Search ..... 313/493, 318.01, 313/318.08, 317, 318.09, 634; 362/216

(56) References Cited

U.S. PATENT DOCUMENTS 4,281,238 A * 7/1981 Noma et al. ..... 219/535
4,324,998 A * 4/1982 Gilmore et al. ..... 313/318.05
4,326,146 A * 4/1982 Plagge et al. ..... 313/318.05
4,878,854 A * 11/1989 Cannon ..... 439/236
4,949,007 A * 8/1990 Takagi et al. ..... 313/318.02
5,796,210 A 8/1998 Sakakibara et al. ..... 313/493
6,286,971 B1 * 9/2001 Hori ..... 362/31
6,342,763 B1 * 1/2002 Fukushima et al. ..... 313/623

FOREIGN PATENT DOCUMENTS

JP 06338289 A * 12/1994 ..... H01J/61/30
JP 11-3682 1/1999
JP 11162329 A * 6/1999 ..... H01J/5/50

* cited by examiner

*Primary Examiner*—Joseph Williams
*Assistant Examiner*—Sikha Roy
(74) *Attorney, Agent, or Firm*—Pillsbury Winthrop LLP

(57) ABSTRACT

A circular fluorescent lamp comprises a light-transmitting circular tube, filled with a discharge gas including mercury and a rare gas, having an outer diameter between about 14 mm and 18 mm. A phosphor layer is coated on the inner surface of the light-transmitting circular tube. A stem seals each end of the light-transmitting circular tube air-tightly, and holds a pair of conductive wires. One of the ends of each pair are connected to a filament, and the other of the ends extend outwardly from the circular tube. A lamp base is arranged between the ends of the light-transmitting circular tube so as to rotate slightly around the center axis of the circular tube and includes conductive pins, which are connected to the conductive wires. An insulator, arranged between at least one pair of the conductive wires, limits the movement of the conductive wires. The circular fluorescent lamp may be used for a lighting fixture.

9 Claims, 7 Drawing Sheets

CIRCULAR FLUORESCENT LAMP INCLUDING AN INSULATOR BETWEEN CONDUCTIVE WIRES, AND A LIGHTING FIXTURE USING THE LAMP

BACKGROUND OF THE INVENTION

1. Field of the Invention

The present invention relates to a circular fluorescent lamp having a tube with a small outer diameter, and a lighting fixture using the lamp.

2. Description of the Related Art

Generally, it is known that the luminous efficacy of a fluorescent lamp changes according to the mercury-vapor pressure ratio of the lamp. The mercury-vapor pressure is controlled by the temperature of a cold spot, which is the coldest portion of the fluorescent lamp during the lamp operation. When the temperature of the cold spot becomes high, more mercury evaporates, so that the luminous flux of the fluorescent lamp can increase. If the temperature of the cold spot becomes too high, then the luminous flux decreases, because, the in excess evaporated mercury absorbs ultraviolet rays generated in the fluorescent lamp, which are changed to visible light.

A circular fluorescent lamp, having an outer tube diameter of about 29 mm and an overall circular outer diameter of 225 mm, can appropriately maintain the cold spot temperature. However, recently, fluorescent lamps having a small tube outer diameter have become available. The temperature of the fluorescent lamp tends to increase because of the small volume of the tube, so that the cold spot can not be appropriately maintained at the proper temperature in the fluorescent lamp. Accordingly, the cold spot can not control the mercury-vapor pressure of the lamp, so that the luminous efficacy may be reduced.

In order to maintain the cold spot of the fluorescent lamp at the proper temperature, Japanese Laid Open Patent Application HEI 11-3682 discloses a circular fluorescent lamp having long and short stems, which seal opposite ends of the tube of the fluorescent lamp. That is, one stem including conductive wires and filament is longer than the other stem. As a result, the longer stem side of the fluorescent lamp has the cold spot. Since the filament generating heat near the long stem is far from the end of the tube as compared with that of the short stem, the end of the long stem of the tube is easily cooled during the lamp operation as compared with the other portions of the tube.

Such circular fluorescent lamp will be described in more detail by way of example shown in FIG. 8 which shows an enlarged longitudinal section around the ends of a conventional fluorescent lamp. The circular fluorescent lamp 30 is provided with a circular tube 31 having a tube outer diameter of 16.5 mm. A pair of stems 32, 33 seal respective ends of the tube 31, which are accommodated by a lamp base 36 having pins 37. Each of stems 32, 33 comprises conductive wires 35, and a filament 34 connected between conductive wires 35. A length H1 of one stem 32 is formed longer than a length H2 of the other stem 33. The lamp base 36 can rotate around the center axis of the circular tube 31. In this case, when the in fluorescent lamp lights, the cold spot 38 occurs at the sealing portion associated with the stem 32, because, the filament 34 generating heat is further apart from the sealing portion for the stem 32.

The conductive wires 35 extended outwardly from the stem 32 are longer than those of the stem 33. Furthermore, the outer conductive wires 35 of the stems 32, 33 are loosely connected to the pins 37. Accordingly, when the lamp base 36 is rotated about within +15 degrees to −15 degrees around the center axis of the tube 31, each of the conductive wires 35 moves with the lamp base 36. As a result, the conductive wires 35 occasionally touch each other. In particular, the touching occurs easily at the side of longer stem 32 because of the looseness of the long outer conductive wires 35. As a result, conductive wires 35 are shorted. If a short circuit occurs, the electrical ballast may be damaged.

SUMMARY OF THE INVENTION

According to one aspect of the invention, a circular fluorescent lamp comprises a light-transmitting circular tube, filled with a discharge gas including mercury and a rare gas, having an outer tube diameter in the range of about 14 mm to about 18 mm. A phosphor layer is coated on the inner surface of the light-transmitting circular tube. Each of the stems, sealing opposite ends of the light-transmitting circular tube, holds a pair of conductive wires, of which one end of each is connected to a filament, and the other end of each extends outwardly from the circular tube. A lamp base, arranged between the ends of the light-transmitting circular tube so as to rotate slightly around the center axis of the circular tube, fixes conductive pins which are connected to the conductive wires. An insulator, arranged between the conductive wires, limits the movement of the conductive wires.

According to another aspect of the invention, a lighting fixture comprises the circular fluorescent lamp. A ballast supplies the electric power to the circular fluorescent lamp. The circular fluorescent lamp and the ballast are arranged in a body.

These and other aspects of the invention will be further described in the following drawings and detailed description of the invention.

BRIEF DESCRIPTION OF THE DRAWINGS

In the following, the invention will be described in more detail by way of examples illustrated by drawings in which.

DETAILED DESCRIPTION OF SEVERAL EMBODIMENTS OF THE INVENTION

Figure 1:
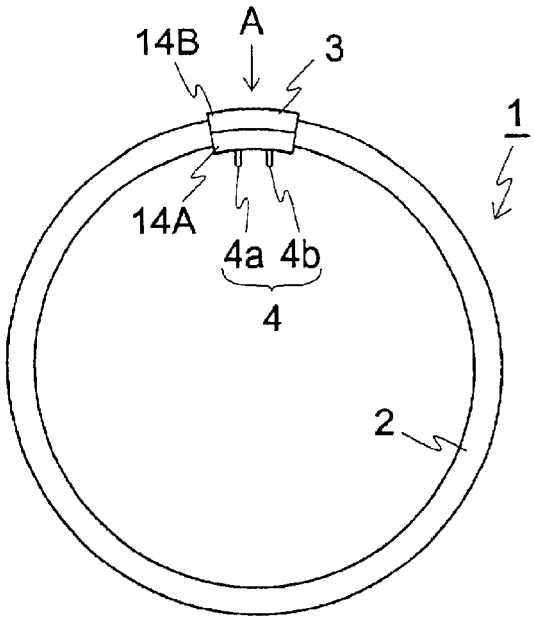
FIG. 1 is a front view of a circular fluorescent lamp according to a first embodiment of the present invention.

FIG. 1 shows a front view of a circular fluorescent lamp according to first embodiment of the present invention. The circular fluorescent lamp 1 shown in FIG. 1 is provided with a light-transmitting circular tube 2 having a 16.5 mm tube outer diameter, a 14.1 mm tube inner diameter, and a 1.2 mm thickness. The light-transmitting circular tube 2 is filled with a discharge gas including mercury and a rare gas, e.g., xenon. A lamp base 3 is arranged between the ends of the circular tube 2, and has four conductive pins 4*a*, 4*b*, 4*c*, and 4*d* extending outwardly therefrom.

The light-transmitting circular tube may be deformed, or formed into ellipse shape. The tube may have an outer diameter in a range of 14 mm to 18 mm.

A circular outer diameter the same as any of the circular fluorescent lamps may be used in this invention. For example, the circular outer diameter of the circular tube may be approximately 225 mm (or between about 230 mm and about 220 mm) at the rated lamp power of about 20 W or 28 W that supplies very high frequency voltage to the lamp (hereinafter 20/28 W type). The outer diameter of the circular tube may be about 299 mm (or between about 305 mm and about 293 mm) for a rated lamp power of about 27 W or 38 W (with the same high frequency). The outer diameter of the circular tube may be about 373 mm (or between about 379 mm and about 367 mm) for a rated lamp power of about 34 W or 48 W (with the same high frequency). Furthermore, the outer diameter of the circular tube may be about 447 mm (or between about 453 mm and about 441 mm) for a rated lamp power of 41 W or 58 W (with the same high frequency). Each of circular outer diameters of the 20/28 W type, the 27/38 W type, and the 34/48 W type is respectively the same as the circular outer diameter of the conventional 30 W circular fluorescent lamp type, the conventional 32 W type, and the conventional 40 W type. These fluorescent lamps are lit by an electrical ballast generating a high frequency voltage.

The lamp base 3 made of plastic includes a pair of bodies 14A, 14B, which are fixed to each other by driving a screw through a hole 15. Ends 2A, 2B of the circular tube 2 are covered by the lamp base 3. The conductive pins 4*a*, 4*b*, 4*c*, and 4*d* project from the body 14A at an angle of 45 degrees from a plane containing an axis extending circumferentially along the cross-sectional center of the tube 2. The lamp base 3 can rotate about at the angle from +15 to −15 degrees around the center axis of the circular tube 2. Therefore, each of the outer conductive wires 7*c*, 7*d*, 8*c*, and 8*d*, which extend from pinched portions 10A, 11A of the stems 10, 11 to the pins 4, are loose so that the lamp base 3 can rotate around the center axis of the circular tube 2. If the conductive wires 7*c*, 7*d*, 8*c*, and 8*d* are not loose, the lamp base 3 can not rotate around the above-mentioned axis, so that it is difficult for the conductive pins 4*a*, 4*b*, 4*c*, and 4*d* to be insert in a socket (not shown) arranged on a lighting fixture.

Figure 2:
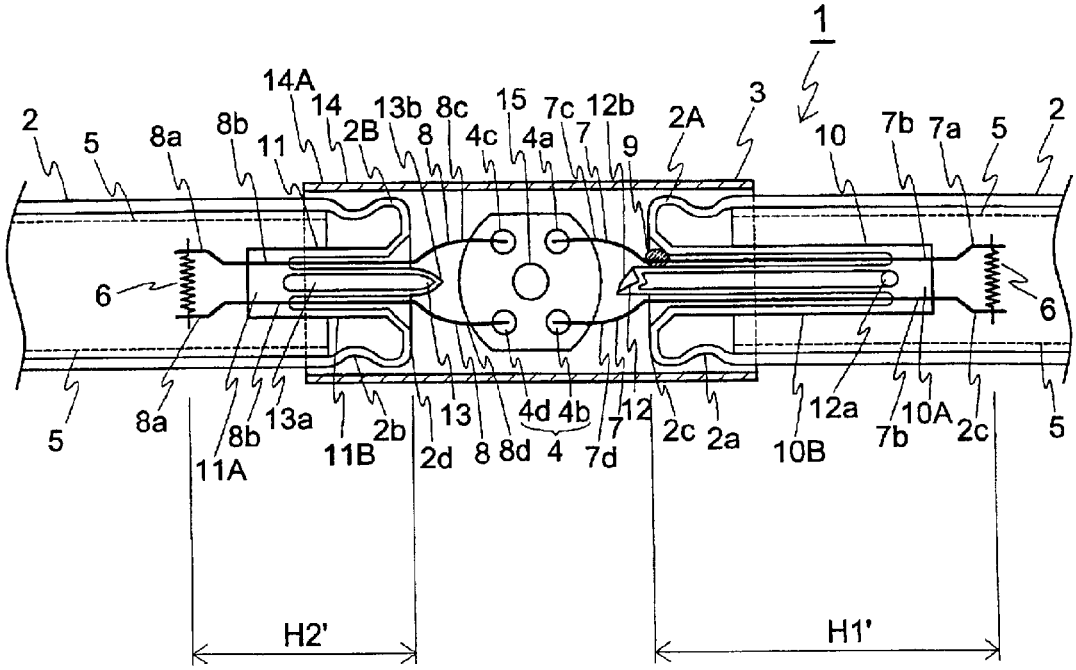
FIG. 2 is an enlarged longitudinal section around the ends of the fluorescent lamp shown in FIG. 1.
Figure 3:
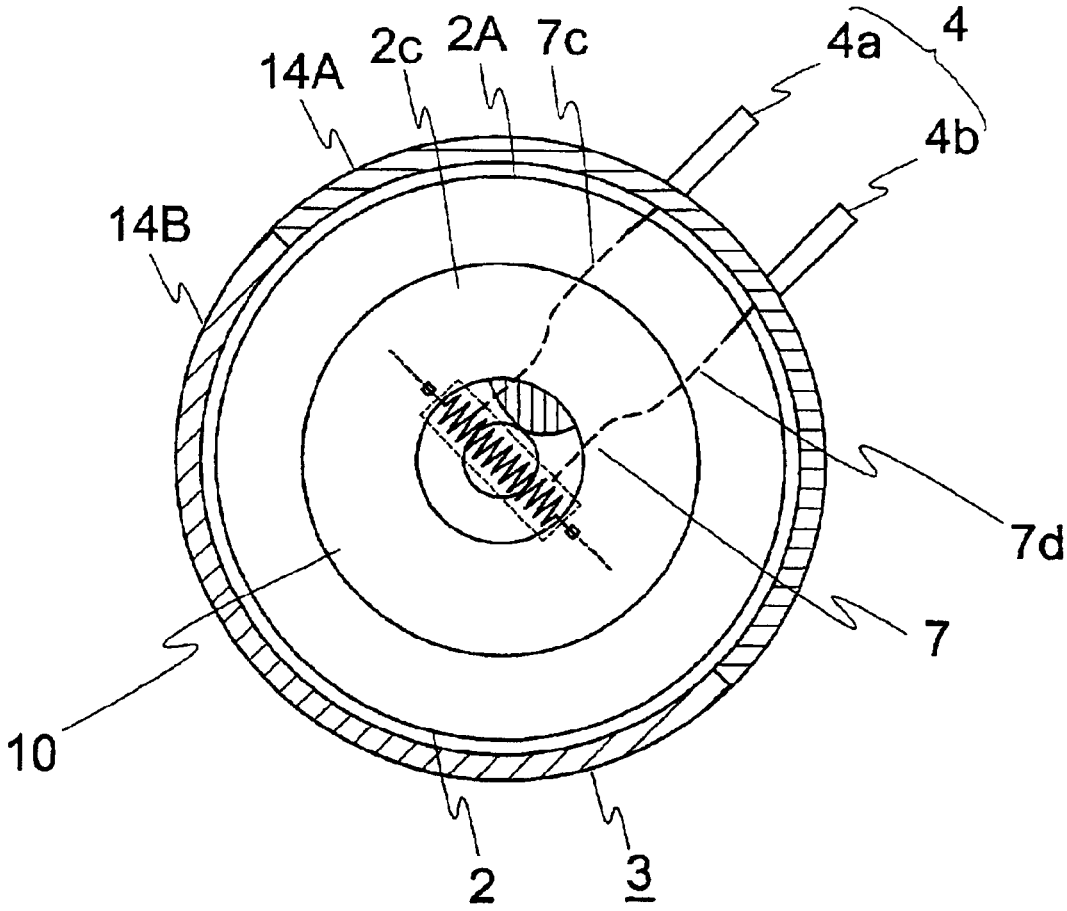
FIG. 3 is an enlarged cross section of the fluorescent lamp shown in FIG. 2.

FIG. 2 shows an enlarged longitudinal section around both ends of the fluorescent lamp shown in FIG. 1. The circular fluorescent lamp further comprises a phosphor layer 5 coated on the inner surface of the light-transmitting circular tube 2. Each of stems 10, 11, sealing ends 2A, 2B of the circular tube 2, holds conductive wires 7, 8. Each of filaments 6 is respectively connected to conductive wires 7, 8. An insulator 9 is arranged between the conductive wires 7*c*, 7*d*. The insulator 9 also is arranged between an exhaust tube 12 held by the stem 10 and the sealing portion 2*c*. Therefore; the movement of the conductive wires 7*c*, 7*d* is limited, so that the conductive wires 7*c*, 7*d* do not easily touch. In order words, the insulator 9 can separate the movement range of conductive wire 7*c* from wire 7*d*.

Each of the conductive wires 7, 8 respectively comprises an inner conductive wire 7*a*, 8*a*, a sealing wire 7*b*, 8*b*, e.g., a dumet wire made of Fe—Ni wire covering copper, and an outer conductive wire 7*c*, 7*d*, 8*c*, and 8*d*. Each of the sealing wires 7*b*, 8*b* is respectively embedded in the pinched portions 10A, 11A of the stems 10, 11. Each of filaments 6 is connected between the ends of the inner conductive wires 7*b*, 8*b*. The axes of the filaments 6 and the conductive pins 4*a*, 4*b*, 4*c*, and 4*d* are arranged perpendicularly to each other. The space between the filaments 6 forms a discharge path. Furthermore, each of the outer conductive wires 7*c*, 7*d*, 8*c*, and 8*d* extends outwardly from the pinched portions 10A, 11A of the stems 10, 11. The conductive wires 7*c*, 7*d* are arranged to be widely spaced. The outer conductive wires 7*c*, 7*d*, 8*c*, and 8*d* are respectively connected to the four conductive pins 4*a*, 4*b*, 4*c*, and 4*d*. That is, the outer conductive wires 7*c*, 7*d*, 8*c*, and 8*d* are arranged in the same plane and are inserted in the nearest conductive pins 4*a*, 4*b*, 4*c*, and 4*d* respectively as shown in FIG. 2.

Each of the stems 10, 11 is provided with the exhaust tube 12, of which one end is connected to the pinched portion 10A, 11A opening hole 12*a*, 13*a*, in a flare portion 10B, 11B. The other end of the exhaust tube 12 extends from the stem 10, 11, so that the exhaust tube 12 can exhaust and introduce a gas within the circular tube 2. After the gas is filled in the circular tube 2 through the exhaust tube 12, each of the other ends of the exhaust tubes 12 is cut off at a tip off portion 12*b*, 13*b*. The length H1', which is a distance from the filament 6 to the tip of the sealing portion 2*c* of the stem 10, e.g., 27 mm, is longer than the length H2' of, e.g., 12 mm, of the other stem 11. Accordingly, the cold spot of the fluorescent lamp tends to occur at the sealing portion 2*c* of the circular tube 2, because the cold spot is separated from the filament or a discharge arc.

With long stem 10, the length of the outer conductive wires 7*c*, 7*d* also is longer, so that the wires can touch more easily when the lamp base 3 rotates around the center axis of ad the circular tube 2. In this embodiment, however, the insulator 9 can limit the movement of the outer conductive wires 7*c*, 7*d*, so that the conductive wires 7*c*, 7*d* do not touch each other. According to this embodiment, when the lengths H1', H2' of the stems 10, 11 are within about 20 mm to about 40 mm, and within about 10 mm to about 30 mm, respectively, the cold spot can easily occur at the sealing portion 2*c*. If the length H1' of the stem 10 is less than about 20 mm, the cold spot is not formed because of heat from the filament. When the length H1' of the stem 10 is more than about 40 mm, the filament 6 is adjacent to or contacts the inner surface of the circular tube 2, in case of the circular fluorescent lamp having a circular outer diameter of about 210 mm, for example.

Figure 5:
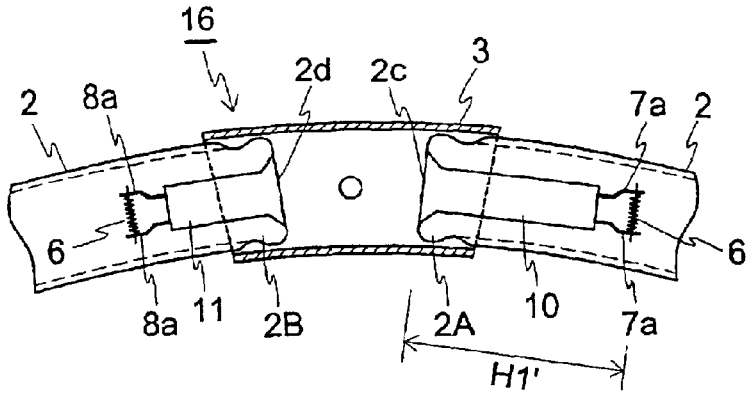
FIGS. 5(*a*) to 5(*c*) are enlarged longitudinal sections around the ends of the fluorescent lamp shown in FIG. 1, which respectively show different arrangements of a filament mounted on a stem.
Figure 5:
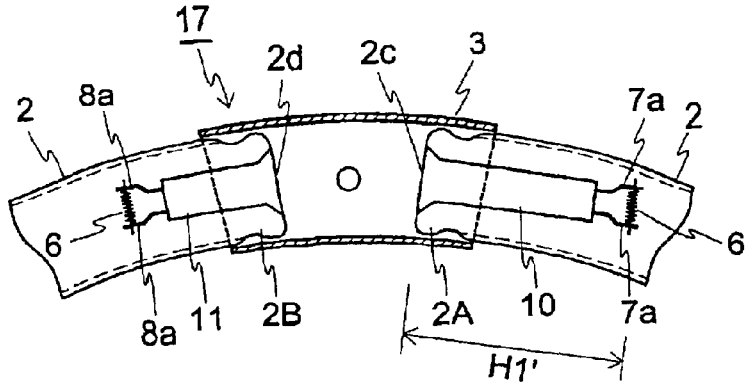
Figure 5:
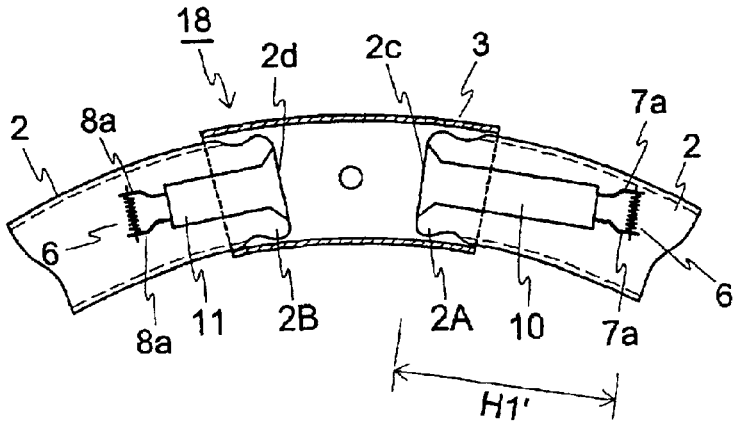

FIGS. 5(*a*) to 5(*c*) show an enlarged longitudinal section of the ends of the fluorescent lamp shown in FIG. 1. The dimensions of each of the fluorescent lamps are shown in the following TABLE 1.

TABLE 1

| | Lamp 16 FIG. 5(a) | Lamp 17 FIG. 5(b) | Lamp 18 FIG. 5(c) |
|---|---|---|---|
| Length H1' of the stem 10 | 40 mm | 40 mm | 40 mm |
| Length of the inner conductive wires 7a | 10 mm | 10 mm | 10 mm |
| Tube outer diameter | 16.5 mm | 16.5 mm | 16.5 mm |
| Circular outer diameter | 373 mm | 299 mm | 225 mm |
| Lamp power converted into a conventional lamp | 40 W | 32 W | 30 W |

If the maximum length H1' of the stem 10 is 40 mm, the filament 6 of the fluorescent lamp 18 is likely to touch the tube 2 as shown in FIG. 5(*c*). If the length of the stem is As too short, the cold spot can not be appropriately formed at the sealing portion 2*c* of the tube 2. Since the length H2' of the stem 11, in the range of about 10 mm to about 30 mm, is shorter in comparison with the length of the stem 10, the cold spot is formed at the sealing portion 2*c* of the stem 10.

The insulator 9, e.g., silicone rubber, having a hardness of 40 or less measured by Japanese Industrial Standard K 6301 (as determined by testing method for a vulcanization rubber JIS K6301), adheres to the tip of the sealing portion 2*c* and between the outer conductive wires 7*c*, 7*d*. Accordingly, outer conductive wires 7*c*, 7*d* do not touch each other. The insulator may also be arranged between the outer conductive wires 8*c*, 8*d*. This is useful when the length H2' of the stem 11 is between about 20 mm and about 30 mm. The insulator may be formed into a tube shape covering the wires.

The insulator 9 tends to harden because of the heat generated by the fluorescent lamp, so that its elasticity decreases. Therefore, the insulator 9 can not appropriately expand in comparison with an expansion of the glass of the circular tube 2 caused by the heat of the lamp. If the hardness of the insulator 9 is more than 40, the glass of the tube 2 is likely to crack. When the hardness of the insulator 9 is 40 or less, the fluorescent lamp is prevented from cracking during the lamp life. It is more preferable for the insulator to have a hardness of 30 or less. The silicone rubber, made of silicone plastic able to withstand high heat and ultraviolet light, may be a gel structure.

A method for forming the insulator 9 is as follows. First, after gas is exhausted from the circular tube 2 and replaced with a predetermined gas, the circular tube 2 is held at a temperature of 80 degrees centigrade or more. Then, a silicone liquid, which will be hardened by heat, is adhered at the sealing portion 2*c* of the circular tube 2 and between outer conductive wires 7*c*, 7*d*. As the circular tube 2 is baked, the silicone liquid changes into the silicone rubber.

After the fluorescent lamp was manufactured, a thermal shock test from 0 to 100 degrees centigrade and a test for lighting the lamp were performed. When the hardness of the silicone rubber was 45 as measured by the above-mentioned JIS K6301, the glass of the circular tube 2 rarely cracked. When the hardness was 50, the circular tube 2 cracked 50% of the time. When the hardness was 40 or less, the circular tube 2 never cracked. In particular, when the hardness of the silicone rubber was 30, the circular tube 2 did not crack during the lamp operation. When the hardness of the silicone rubber was 45, the stress at the sealing portion 2*c* and the exhaust tube 12 was 100 Kg/cm$^2$ or more. When the hardness of the silicone rubber was 40, the stress at the sealing portion 2*c* and the exhaust tube 12 was too low to measure.

Figure 4:
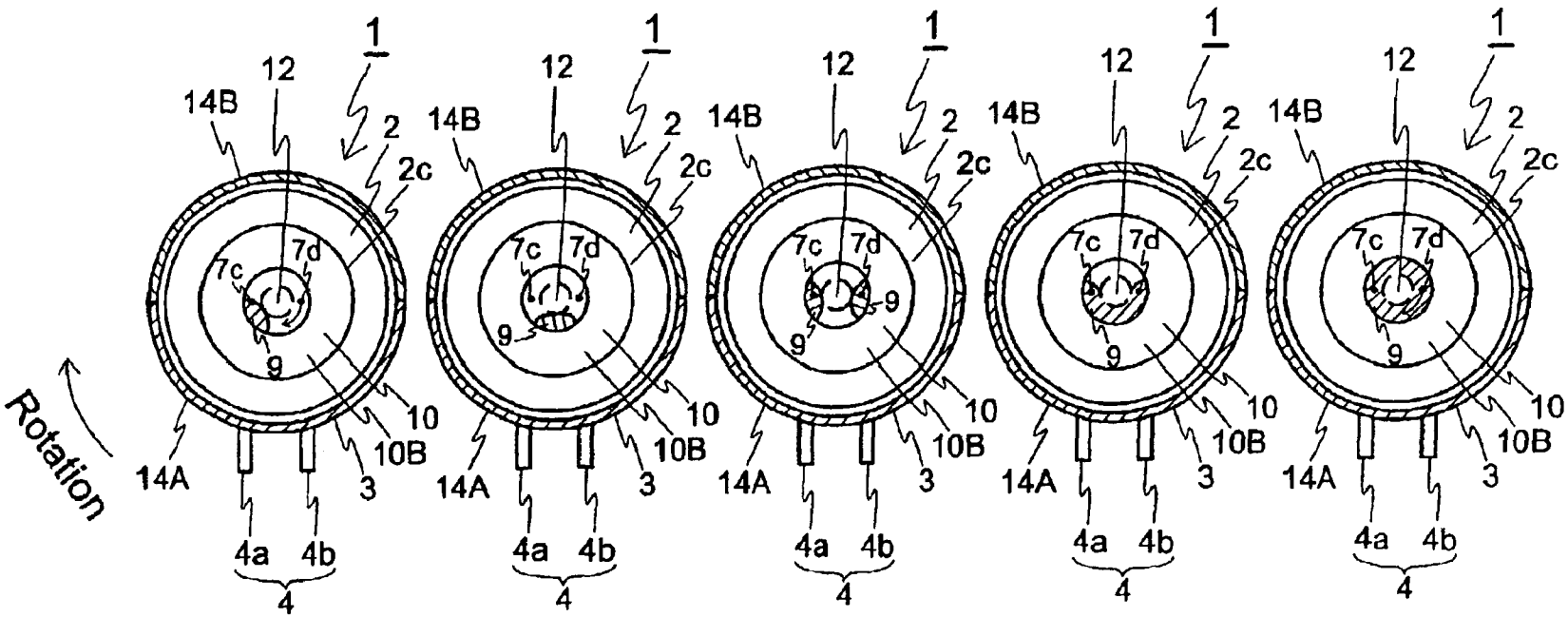
FIGS. 4(*a*) to 4(*e*) are enlarged cross sections of the fluorescent lamp shown in FIG. 2, which respectively show different locations of an insulator.

FIGS. 4(*a*) to 4(*e*) are enlarged cross sections of the fluorescent lamp shown in FIG. 2, with different locations of the insulator, respectively. FIG. 4(*a*) shows the silicone rubber 9 arranged between outer conductive wires 7*c*, 7*d* and fixed around the outer conductive wire 7*c*. FIG. 4(*b*) shows the silicone rubber simply arranged between outer conductive wires 7*c*, 7*d*. FIG. (4*c*) shows two portions of silicone rubber 9, 9, each respectively fixed to one of the outer conductive wires 7*c*, 7*d*. FIG. 4(*d*) shows the silicone rubber arranged in the entire space between outer conductive wires 7*c*, 7*d* on one side of the tube. FIG. 4(*e*) shows the silicone rubber 9 filling the entire space between the exhaust tube and flare portion 12 of the stem 10.

When the silicone rubber 9 projects from the tip of the sealing portion 2*c*, it is easy to check an adhesive condition of the silicone rubber Thus, the silicone rubber holds the outer conductive wire 7*c*, so that the movable range of the wire 7*c* from the rubber 9 to the pin 4*a* is limited in comparison with the movable range of the other wires 7*d*, 8*c*, and 8*d*, i.e., from pinched portion 10A, 11A to the pins 4*b*, 4*c*, and 4*d*. The silicone rubber contains titanium oxide, so that the color is white. Accordingly, it is easy to check the condition of the rubber. Any color may be useful. Besides, as the rubber can radiate heat conducted from the filament, the cold spot is able to form easily around the end 2A of the circular tube 2.

Next, the performance of the circular fluorescent lamp of this embodiment will be explained. When the lamp base 3 rotates, the outer conductive wires 7*c*, 7*d*, extending from the one end 2A of the lamp and outer conductive wires 8*c*, 8*d*, of the other end 2B, move with the lamp. However, the silicone rubber is arranged between outer conductive wires 7*c*, 7*d* and fixes the conductive wire 7*c*. Accordingly, even if the lamp base 3 rotates, the movement of outer conductive wires 7*c*, 7*d* is limited by the silicone rubber 9. Therefore, outer conductive wires 7*c*, 7*d* can not easily touch each other. The silicone rubber 9 may be simply arranged between outer conductive wires 7*c*, 7*d*.

Figure 6:
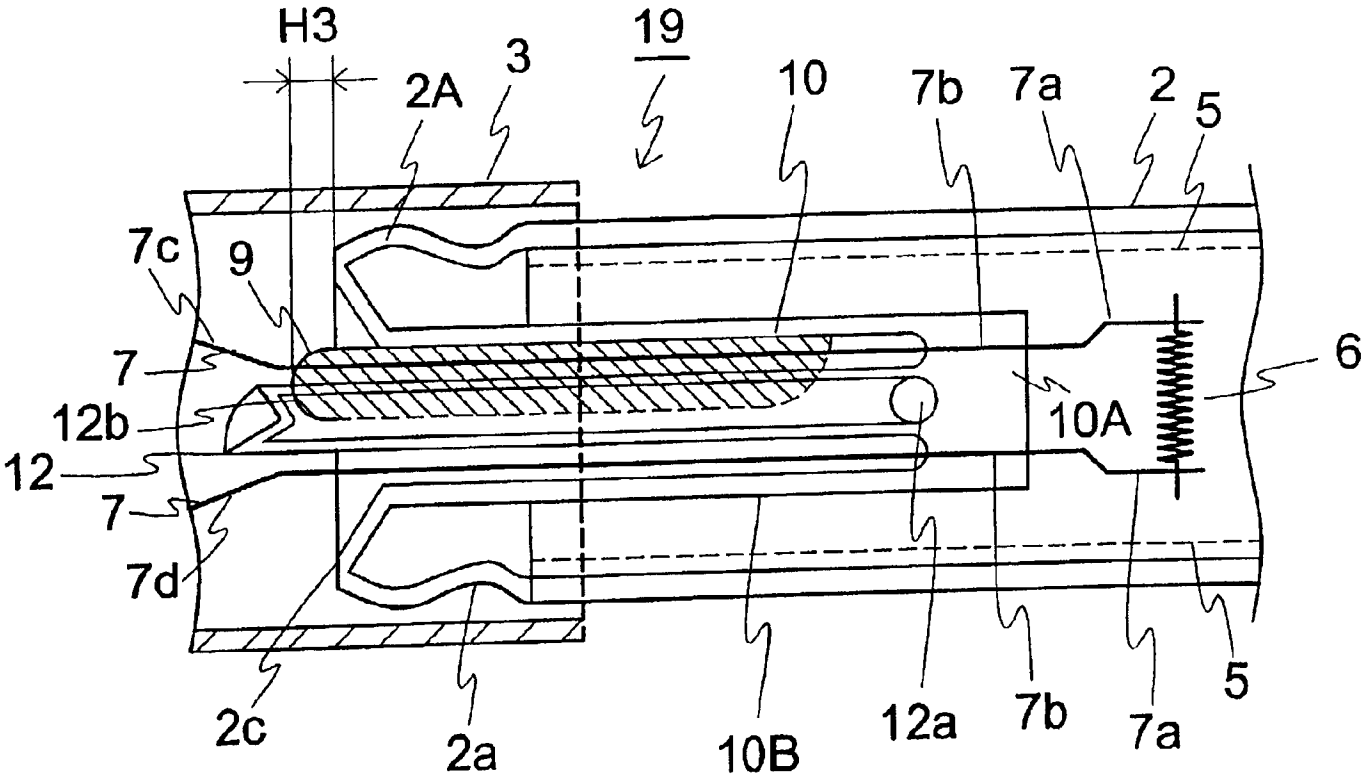
FIG. 6 is an enlarged longitudinal section around an end of a fluorescent lamp according to a second embodiment of the present invention.

Referring to FIG. 6, a second embodiment of the invention will be explained. Similar reference characters designate identical or corresponding elements as in the first embodiment. Therefore, a detailed explanation of such similar structure will not be provided. The fluorescent lamp 19 includes silicone rubber 9 poured between a flare portion 10B of a stem 10 and an exhaust tube 12. The silicone rubber 9 projects from a tip of the sealing portion 2*c*. The silicone rubber 9 is shown at slanting lines in FIG. 6. Since the silicone rubber 9 is projected from the tip of the sealing portion 2*c*, it is easy to check an adhesive condition of the silicone rubber 9. The length H3 of the projection may be between about 0.5 mm and about 2 mm.

The silicone rubber 9, which extends inwardly adjacent to pinched portion 10A, outwardly conducts heat generated by the filament. Accordingly, the cold spot can be easily formed at the end of the circular tube 2. In this embodiment, when the hardness of the silicone rubber is 45, a stress at the sealing portion 2*c* and the exhaust tube 12 is 100 Kg/cm$^2$ or more. Furthermore, when the hardness of the silicone rubber is 40, the stress at the sealing portion 2*c* and the exhaust tube 12 is 50 Kg/cm$^2$. When the hardness of the silicone rubber is 30, the hardness is too low to measure. Therefore, the fluorescent lamp does not crack at the sealing portion 2*c* and the exhaust tube 12.

Figure 7:
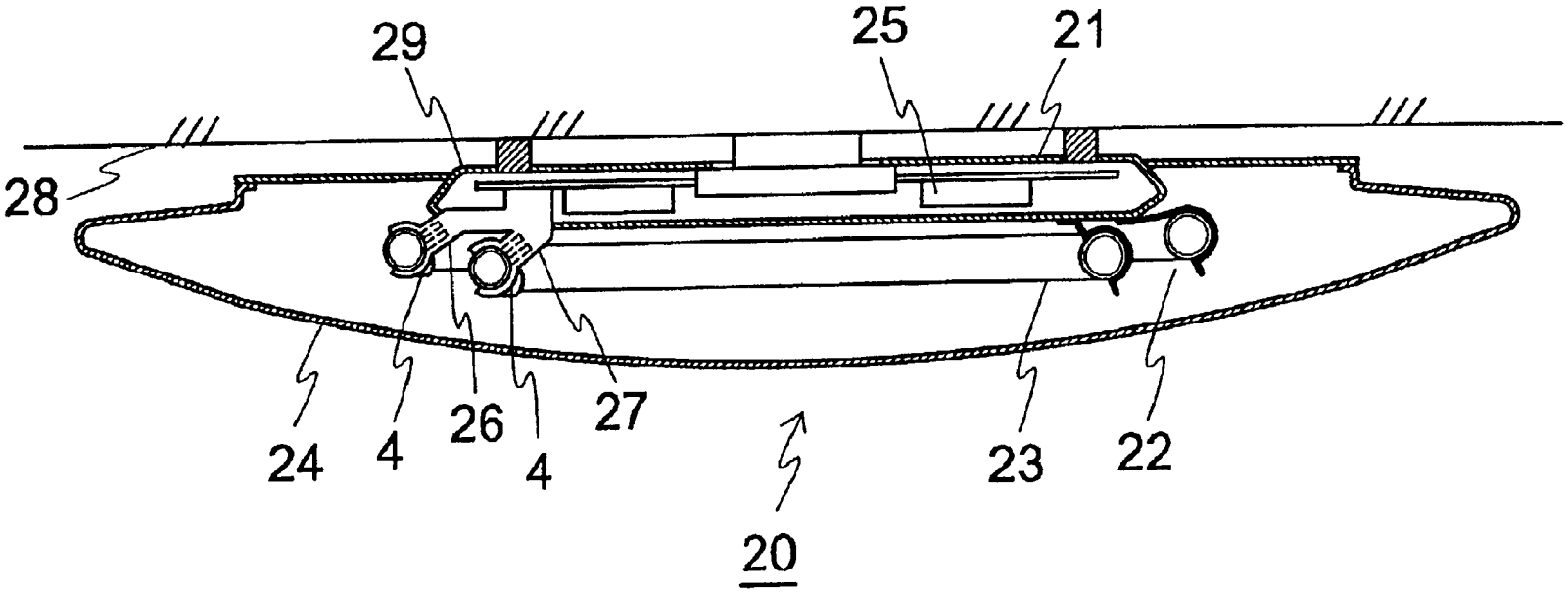
FIG. 7 is a side view, partly in section, of a lighting fixture according to the present invention.
Figure 8:
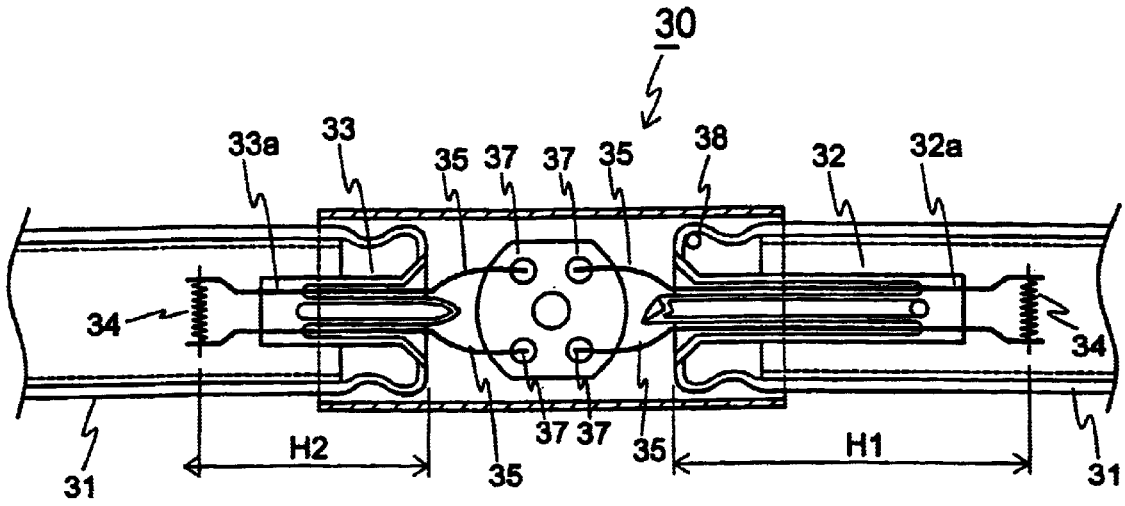
Fig.8 Prior Art
FIG. 8 is an enlarged longitudinal section around the ends of a conventional fluorescent lamp.

Referring to FIG. 7, third embodiment of the invention will be explained hereinafter. Similar reference characters designate identical or corresponding to the elements of above-mentioned first or second embodiment. Therefore, detail explanations of the structure will not be provided.

FIG. 7 shows a side view, partly cross section, of a lighting fixture according to the present invention. The lighting fixture 20 is provided with a body 21 having lamp sockets 26, 27. Two circular fluorescent lamps 22, 23 have different circular outer diameters. A shade 24 covers the fluorescent lamps 22, 23. An electrical ballast 25 supplies a high frequency voltage to the fluorescent lamps 22, 23. The dimensions of the circular fluorescent lamps 22, 23 is shown in TABLE 2.

TABLE 2

| | Lamp 22 | Lamp 23 |
|---|---|---|
| Tube outer diameter | 16.5 mm | 16.5 mm |
| Circular outer diameter | 373 mm | 299 mm |
| Lamp power | 34 W | 27 W |

Since each of the circular fluorescent lamps 22, 23 comprises a lamp of the first or second embodiment, the fluorescent lamps can form the cold spot at the sealing portion 2*c* of the circular tube 2. As a result, the mercury-vapor pressure of the lamps is maintained at a pre-determined level, so that the luminous efficacy of the lamps improves. Accordingly, in this embodiment, the luminous efficacy of the fluorescent lamp is 10% or more greater than a conventional lamp having a 29 mm tube outer diameter and also is of a small size. Moreover, even if the lamp base 3 rotates slightly when the conductive pins of the fluorescent lamp are inserted into the lamp sockets 26, 27, the movement of the conductive wires 7*c*, 7*d* in the lamp base 3 is limited by the silicone rubber 9. Accordingly, the conductive wires 7*c*, 7*d* do not contact each other, so that conductive wires 7*c*, 7*d* do not short. The lighting fixture may further comprise a means for sinking heat 29, e.g., an airflow hole, a heat pipe, or blower fan adjacent to the sealing portion 2*c* of the tube 2.

What is claimed is:

1. A circular fluorescent lamp comprising:

a light-transmitting circular tube, filled with a discharge gas including mercury and a rare gas, having a tube outer diameter between about 14 mm and 18 mm;

a phosphor layer coated on the inner surface of the light-transmitting circular tube;

a stem sealing each end of the light-transmitting circular tube air-tightly;

a filament at each end of the light-transmitting circular tube;

a pair of conductive wires held in each stem, one of the ends of each pair being connected to one of the filaments, and the other of the ends of each pair extending outwardly from the circular tube;

a lamp base, arranged between the ends of the light-transmitting circular tube so as to rotate slightly around the center axis of the circular tube, including conductive pins, which are connected to the conductive wires; and an insulator arranged between the conductive wires of at least one pair to provide insulation therebetween, and adhered on the sealing portion of at least one of the stems, at least at a point which is outside of the light-transmitting circular tube.

2. A circular fluorescent lamp according to claim 1, wherein, the length of one stem is longer than that of the other stem.

3. A circular fluorescent lamp according to claim 2, wherein the length of one stem is between about 20 mm and 40 mm, and the length of the other stem is between about 10 mm and 30 mm.

4. A circular fluorescent lamp according to claim 1, wherein an axes of the filament and the conductive pins are arranged perpendicularly to each other.

5. A circular fluorescent lamp according to claim 1, wherein the insulator is made of silicone rubber and adheres to the tip of the sealing portion and between the conductive wires.

6. A circular fluorescent lamp according to claim 5, wherein the silicone rubber has a hardness of 40 or less measured by Japanese Industrial Standard K 6301 (as determined by testing method for a vulcanization rubber JIS K6301).

7. A circular fluorescent lamp according to claim 5, wherein the silicone rubber is colored.

8. A circular fluorescent lamp according to claim 5, wherein the silicone rubber projects from the tip of the sealing portion of the light-transmitting circular tube.

9. A lighting fixture comprising:

a circular fluorescent lamp comprising:

a light-transmitting circular tube, filled with a discharge gas including mercury and a rare gas, having a tube outer diameter between about 14 mm and 18 mm, a phosphor layer coated on the inner surface of the light-transmitting circular tube, a stem, sealing each end of the light-transmitting circular tube air-tightly, a filament at each end of the light-transmitting circular tube, a pair of conductive wires held in each stem, one of the ends of each pair being connected to one of the filaments, and the other of the ends of each pair extending outwardly from the circular tube, a lamp base, arranged between the ends of the light-transmitting circular tube so as to rotate slightly around the center axis of the circular tube, including conductive pins, which are connected to the conductive wires, and an insulator, arranged between at least one pair of the conductive wires, limiting the movement of the conductive wires, and adhered on the sealing portion of at least one of the stems, at least at a point which is outside of the light-transmitting circular tube;

a ballast supplying the electric power to the circular fluorescent lamp; and a body arranging the circular fluorescent lamp and the ballast.

* * * * *